US006738037B1

(12) United States Patent
Akimoto

(10) Patent No.: US 6,738,037 B1
(45) Date of Patent: May 18, 2004

(54) IMAGE DISPLAY DEVICE

(75) Inventor: Hajime Akimoto, Ome (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/031,061

(22) PCT Filed: Jul. 30, 1999

(86) PCT No.: PCT/JP99/04115

§ 371 (c)(1),
(2), (4) Date: Jan. 15, 2002

(87) PCT Pub. No.: WO01/09672

PCT Pub. Date: Feb. 8, 2001

(51) Int. Cl.[7] ..... G09G 3/36
(52) U.S. Cl. ..... 345/96; 345/98
(58) Field of Search ..... 345/96, 98, 90, 345/100, 95, 89, 87, 84, 204, 205; 349/37, 41

(56) References Cited

U.S. PATENT DOCUMENTS 5,021,774 A * 6/1991 Ohwada et al. ..... 345/90
6,069,605 A * 5/2000 Ozawa ..... 345/98
6,281,700 B1 * 8/2001 Matsueda ..... 324/770
6,525,556 B2 * 2/2003 Matsueda ..... 324/770
2002/0033786 A1 * 3/2002 Akimoto et al. ..... 345/87

FOREIGN PATENT DOCUMENTS

| | | |
|---|---|---|
| JP | 55-36844 | 3/1980 |
| JP | 2-204718 | 8/1990 |
| JP | 4-371997 | 12/1992 |
| WO | WO96/16347 | 5/1996 |

OTHER PUBLICATIONS

Lee, S–W. "A Low–Power Poly–Si TFT–LCD with Integrated 8–bit Digital Drivers," *Asia Display 98*, pp. 285–288.

* cited by examiner

*Primary Examiner*—Richard Hjerpe
*Assistant Examiner*—Ronald Laneau
(74) *Attorney, Agent, or Firm*—Miles & Stockbridge P.C.

(57) ABSTRACT

A source voltage of driving an analog buffer (impedance converting means) is shifted between a positive voltage area and a negative voltage area every field with respect to the same pixel.

With the configuration, an offset of the analog buffer can be completely canceled out between fields.

19 Claims, 11 Drawing Sheets

IMAGE DISPLAY DEVICE

TECHNICAL FIELD

The present invention relates to an image display device capable of obtaining a high definition image output.

BACKGROUND ART

A conventional technique related to the present invention will be described hereinbelow with reference to FIGS. 12 and 13.

FIG. 12 is a diagram showing the configuration of a conventional image display device related to the invention. Display elements each constructed by a pixel switch 101 and a liquid crystal display capacitor 102 are arranged in a matrix within a display pixel area 111. The gate of the pixel switch 101 is connected to a gate line driver 110 via a gate line 109. One end of the pixel switch 101 is connected to an analog buffer 104 via a signal line 103. An output of a DA converter 105 is connected to the analog buffer 104. An output of a data latch 106 is connected to the DA converter 105. An output of a shift-register 107 and a digital input signal line 108 are connected to the data latch 106.

The operation of the conventional technique will be described hereinbelow. A digital input signal supplied from the digital input signal line 108 is latched by the data latch 106 in association with scanning of the shift-register 107. The digital input signal latched by the data latch 106 is converted to an analog signal voltage by the DA converter 105 and the analog signal voltage is input to the signal line 103 via the analog buffer 104. When the gate line driver 110 turns on the pixel switch 101 in a selected row via the gate line 109 at a predetermined timing, the analog signal voltage is written into the liquid crystal display capacitor 102 in the selected pixel row.

However, when an offset voltage as a difference between the input and output voltages of an amplifier as a component of the analog buffer 104 varies among the analog buffers 104, a vertical-stripe noise pattern occurs in a display image and a problem such that the picture quality deteriorates seriously occurs. When the analog buffer 104 is constructed by a poly-Si TFT, the problem becomes more conspicuous. A conventional countermeasure against the problem will be described hereinbelow.

FIG. 13 is a circuit configuration diagram of the analog buffer 104. An analog voltage received from an input terminal 127 is supplied to an amplifier constructed by an nMOS 121 and pMOS 122 via a first reset switch 124. An output of the amplifier is input to both the signal line 103 and a second reset switch 125. The other end of the second reset switch 125 is connected to the input of the amplifier via an offset canceling capacitor 123. The input terminal 127 is also connected to the first reset switch 124 and an input switch 126 in parallel, and the other end of the input switch 126 is connected between the second reset switch 125 and the offset canceling capacitor 123.

The operation of the analog buffer 104 will be described hereinbelow. First, the input switch 126 is in the off state and the first and second reset switches 124 and 125 are turned on. In this state, the input and output of the amplifier constructed by the nMOS 121 and the pMOS 122 are applied across the offset canceling capacitor 123, so that an offset voltage as a difference between the input and output voltages of the amplifier is supplied to the offset canceling capacitor 123. Subsequently, when the first and second reset switches 124 and 125 are turned off and the input switch 126 is turned on, a voltage obtained by subtracting the offset voltage value which has been supplied to the offset canceling capacitor 123 is supplied to the amplifier. As a result, the offset voltage of the amplifier is canceled, and the same voltage as that input to the input terminal 127 can be output from the amplifier to the signal line 103. An example of such a conventional technique is specifically described in, for instance, "Asia Display 98, Proceedings", pp. 285 to 288.

DISCLOSURE OF INVENTION

As described above, the conventional technique aims at canceling variations in an offset voltage as a difference between input and output voltages of an amplifier by inserting the capacitor in which the offset voltage is stored at the input of the amplifier by change-over of the switch. According to the method, however, in theory, the input terminal of the amplifier has to be set in a DC floating state and then the amplifier is driven. In this case, when the change-over switch for the capacitor is switched off and the input terminal of the amplifier enters a DC floating state, application of feed-through noise of the change-over switch to the input of the amplifier cannot be avoided. It causes random noise or variations among the amplifiers, and the picture quality accordingly deteriorates. In the conventional technique, the first reset switch 124 corresponds to the change-over switch.

An object of the invention is to provide a novel method of canceling an offset voltage.

The object can be achieved by an image display device including: a display screen in which a plurality of display pixels in each of which a liquid crystal capacitor for displaying an image and a pixel switch for writing an image signal voltage into the liquid crystal capacitor are connected in series are arranged in a matrix, image signal voltage generating means for generating the image signal voltage which changes alternately between a positive voltage and a negative voltage every one of even-numbered and odd-numbered fields to the liquid crystal capacitor, and impedance converting means for reducing an output impedance of the image signal voltage generating means and transmitting the image signal voltage to the pixel switch, wherein the image display device further comprises drive voltage shifting means for shifting a voltage of driving the impedance converting means between a positive voltage area and a negative voltage area every one of the even-numbered and odd-numbered fields in accordance with the polarity of the image signal voltage.

BEST MODE FOR CARRYING OUT THE INVENTION

First Embodiment

An embodiment of the invention will be described hereinbelow with reference to FIGS. 1 to 6 and FIG. 14.

Figure 1:
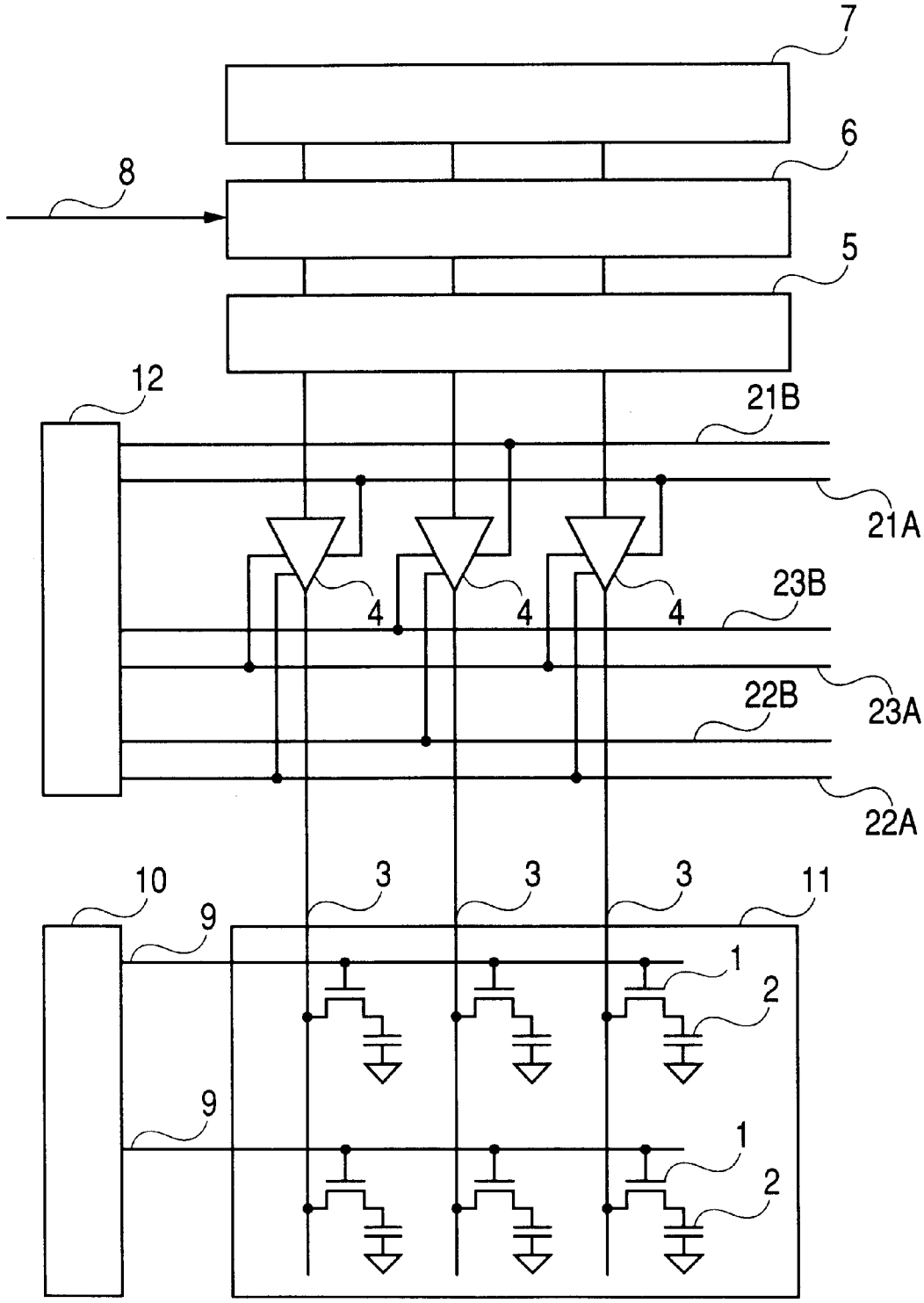
FIG. 1 is a configuration diagram of a first embodiment.

FIG. 1 is a configuration diagram of an embodiment of the image display device according to the invention. Display elements each constructed by a pixel switch 1 and a liquid crystal display capacitor 2 connected in series to one end of the pixel switch 1 are arranged in a matrix within a display pixel area 11. The gate of the pixel switch 1 is connected to a gate line driver 10 via a gate line 9. The other end of the pixel switch 1 is connected to an analog buffer 4 (impedance converting means) via a signal line 3. An output of a DA converter 5 is connected to the analog buffer 4. An output of a data latch 6 is connected to the DA converter 5. An output of a shift-register 7 and a digital input signal line 8 are connected to the data latch 6. Further, to the analog buffer 4, a set of high voltage power lines 21A and 21B, a set of low voltage power lines 22A and 22B, and a set of bias lines 23A and 23B are connected. The high voltage power lines 21A and 21B, low voltage power lines 22A and 22B, and bias lines 23A and 23B are connected to a drive voltage shifting circuit 12. The drive voltage shifting circuit 12 is, as will be described hereinlater, a circuit for supplying a binary low impedance output voltage to output lines.

The operation of the embodiment will be described hereinbelow. A digital input signal supplied from the digital input signal line 8 is latched by the data latch 6 in association with scanning of the shift-register 7. The digital input signal latched by the data latch 6 is converted to an analog signal voltage by the DA converter 5 and the analog signal voltage is input to the signal line 3 via the analog buffer 4. Since the gate line driver 10 turns on the pixel switch 1 in a selected row via the gate line 9 at a predetermined timing, the analog signal voltage is written into the liquid crystal display capacitor 2 in the selected pixel row.

The configuration and operation of the analog buffer 4 will be described in detail hereinbelow.

Figure 2:
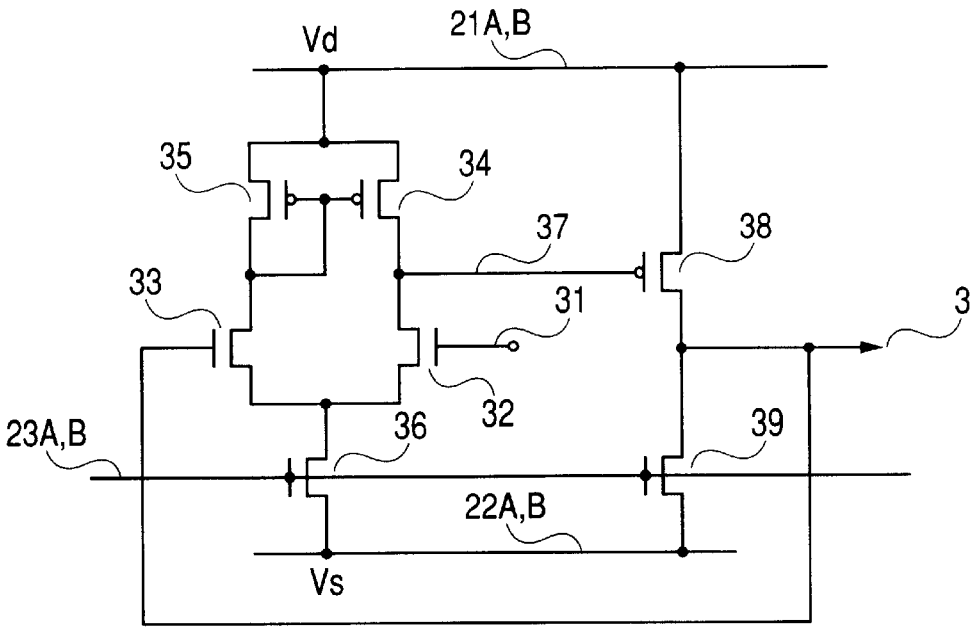
FIG. 2 is a circuit configuration diagram of an analog buffer of the first embodiment.

FIG. 2 is a circuit configuration diagram of the analog buffer 4. An analog voltage input from an input terminal 31 is supplied to a differential amplifier constructed by driver transistors 32 and 33, load transistors 34 and 35, and a current source transistor 36. A differential output line 37 of the differential amplifier is further connected to an amplifier constructed by a driver transistor 38 and a load transistor 39. An output of the amplifier is connected to the signal line 3 and also fed back to the other input terminal of the differential amplifier. With the configuration, it is designed so that the voltage gain of the entire analog buffer 4 becomes almost 1. A high voltage source Vd side of the analog buffer 4 is connected to the high voltage power line 21A or 21B, and a low voltage source Vs side is connected to the low voltage power line 22A or 22B. The gates of the current source transistor 36 and the load transistor 39 are connected to the bias lines 23A and 23B. The odd-numbered and even-numbered analog buffers 4 are alternately connected as shown in FIG. 1 in such a manner that the odd-numbered analog buffers 4 are connected to the high voltage power line 21A, low voltage power line 22A, and bias line 23A, and the even-numbered analog buffers 4 are connected to the high voltage power line 21B, low voltage power line 22B, and bias line 23B.

Figure 14:
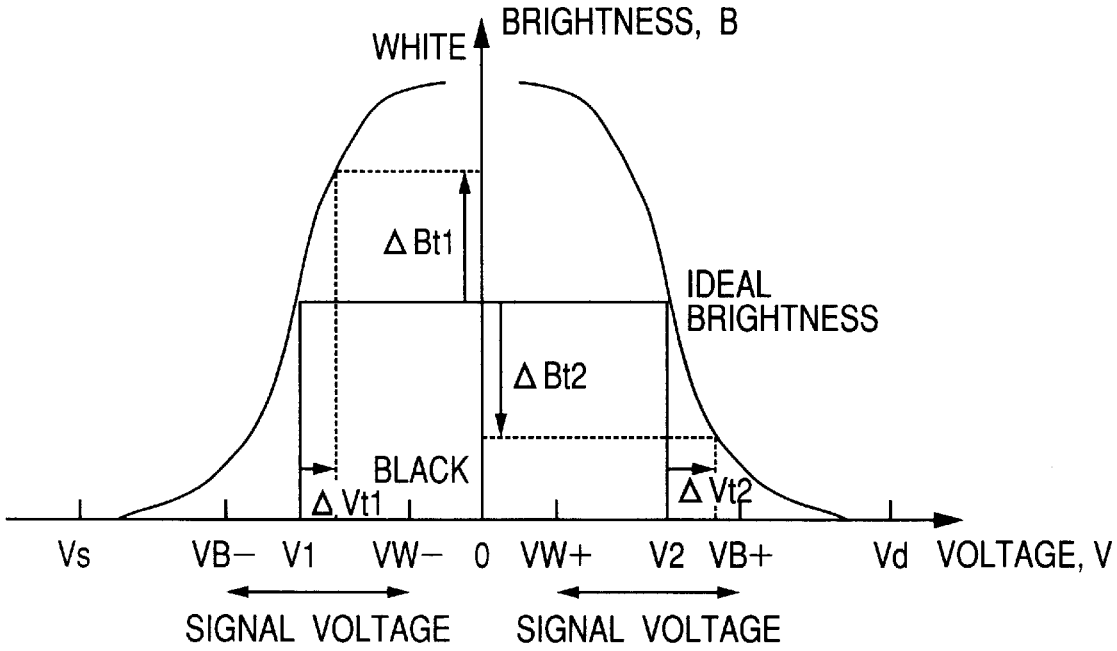
FIG. 14 is a characteristic diagram of display brightness with respect to an input signal voltage.

Prior to explanation of the operation of the analog buffer 4 shown in FIG. 2, the liquid crystal display characteristics of an image signal will be described hereinbelow. FIG. 14 is a characteristic curve of liquid crystal display brightness B with respect to an input signal voltage V. Positive and negative input signal voltages to the liquid crystal are symmetrical. When the absolute value of the input signal voltage is large, black is displayed. To assure the reliability of the liquid crystal, generally, when either the positive or negative voltage is used in the even-number field, the other voltage is used in the odd-number field. In FIG. 14, white display voltages are indicated as VW+ and VW−, and black display voltages are indicated as VB+ and VB−. For example, in the odd-number field, the signal voltage ranges from VB− to VW−. In the even-number field, the signal voltage ranges from VW+ to VB+. It is now assumed that the input signal voltage is influenced by variations in the offset voltage of the analog buffers and, for example, the signal voltage is fluctuated only by $\Delta Vt1$ in the odd-number field and is fluctuated only by $\Delta Vt2$ in the even-numbered field. At this time, due to the variations in the offset voltage, the liquid crystal display brightness fluctuates by $\Delta Bt1$ in the odd-number field and by $\Delta Bt2$ in the even-number field. On average, a display brightness offset of ($\Delta Bt1-\Delta Bt2$) occurs. It is now assumed that signal voltage outputs in the even-numbered and odd-numbered fields are obtained from the same analog buffer, $\Delta Vt1$ and $\Delta Vt2$ are relatively close values, so that the value of ($\Delta Bt1-\Delta Bt2$) can be suppressed to a relatively small value. However, the value of ($\Delta Bt1-\Delta Bt2$) cannot become zero only by the above. Specifically, when the drive source voltages Vs and Vd to the analog buffer are set to be constant, the relation of voltages applied to the transistors constructing the analog buffer in the case where an output signal voltage is V1 and that in the case where an output voltage is V2 are different from each other. Consequently, the offset values $\Delta Vt1$ and $\Delta Vt2$ corresponding to the outputs become different from each other.

Figure 3:
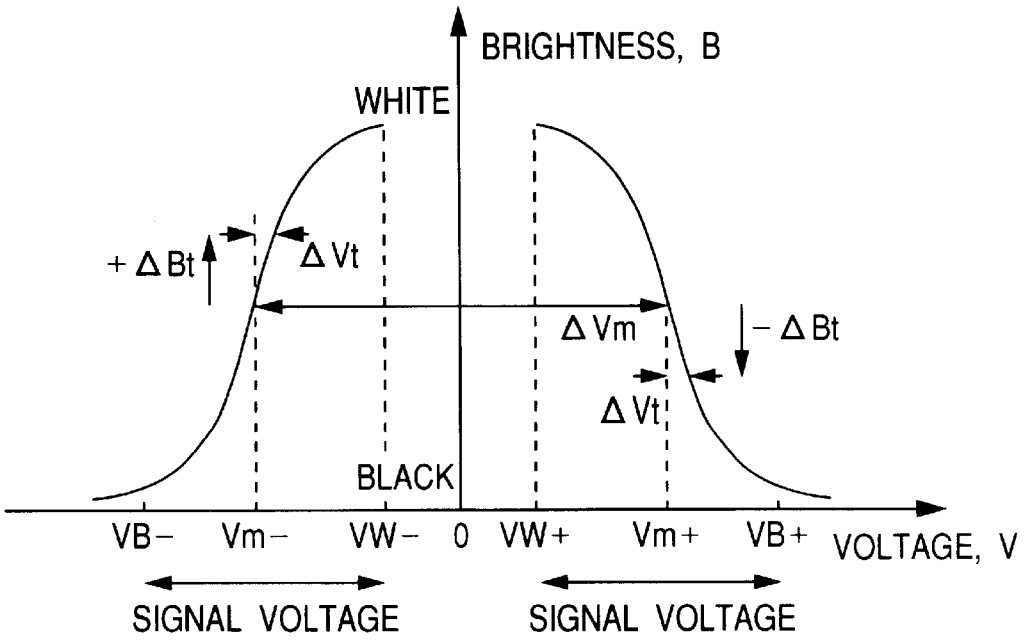
FIG. 3 is a characteristic diagram of display brightness with respect to an input signal voltage of the first embodiment.

In the embodiment, therefore, the analog buffer 4 is shifted as described hereinbelow. FIG. 3 shows the characteristic of the liquid crystal display brightness B with respect to the input signal voltage V in a manner similar to FIG. 14. As shown in the diagram, an input signal voltage in a positive voltage region and that in a negative voltage region where a change in brightness with respect to the input signal voltage gives the maximum slope are indicated as Vm+ (positive voltage region) and Vm− (negative voltage region), and the difference between them is expressed as ΔVm. It is now assumed that the analog buffer 4 is influenced by variations in the offset voltage and the input signal voltage fluctuates only by ΔVt when the inherent output signal voltage is to be Vm−. At this time, the liquid crystal display brightness fluctuates only by +ΔBt as shown in FIG. 3. However, in the invention, all of the voltage for driving the analog buffer 4 in the following field is shifted only by ΔVm and the analog buffer 4 is driven by the resultant voltage. If the inherent output signal voltage of the subsequent analog buffer 4 is Vm+, the fluctuation in the offset voltage also becomes ΔVt, and the liquid crystal display brightness becomes −ΔBt. Since the relations of voltages applied to the transistors constructing the analog buffers 4 in both fields are the same, the values of the offset voltages corresponding to both outputs become the constant value ΔVt. In this case, therefore, the offset of the liquid crystal display brightness in the even-numbered field and that in the odd-numbered field can be completely canceled out each other. As described above, according to the embodiment, by shifting the drive power of the analog buffer 4 in the even-numbered and odd-numbered fields only by ΔVm as a difference between the signal voltages Vm+ and Vm− at which the fluctuation of the liquid crystal display brightness is the largest in association with the variation in the offset voltage of the buffer amplifier 4, the offset in the liquid crystal display brightness in the even-numbered field and that in the odd-numbered field can be ideally canceled out.

Although the shift amount between the drive voltages of the analog buffer 4 in the even-numbered and odd-numbered fields is specified as ΔVm in the embodiment, it is obvious that the larger the value is, the more the offset voltage between fields is canceled on the black display side. The smaller the value is, the more the offset voltage between fields is canceled on the white display side. That is, when the shift amount is given in the range from (VW+)−(VW−) at the minimum and (VB+)−(VB−) at the maximum, the effects of the invention according to the embodiment can be expected. On the contrary, it is also possible to set the shift amount to a value deviated from the value ΔVm on the basis of expected precision of an offset voltage. Further, the signal voltage input to the liquid crystal display capacitor 2 is also influenced by a coupling capacitance in reality when the pixel switch 1 is turned off. To correct the amount, consequently, it is preferable to set the shift amount between the even-numbered and odd-numbered fields of the power sources of the analog buffer 4 to a value slightly smaller than ΔVm. The correction amount at this time can be easily calculated from the value of the liquid crystal display capacitor 2 including the coupling capacitance and parasitic capacitance.

Figure 4:
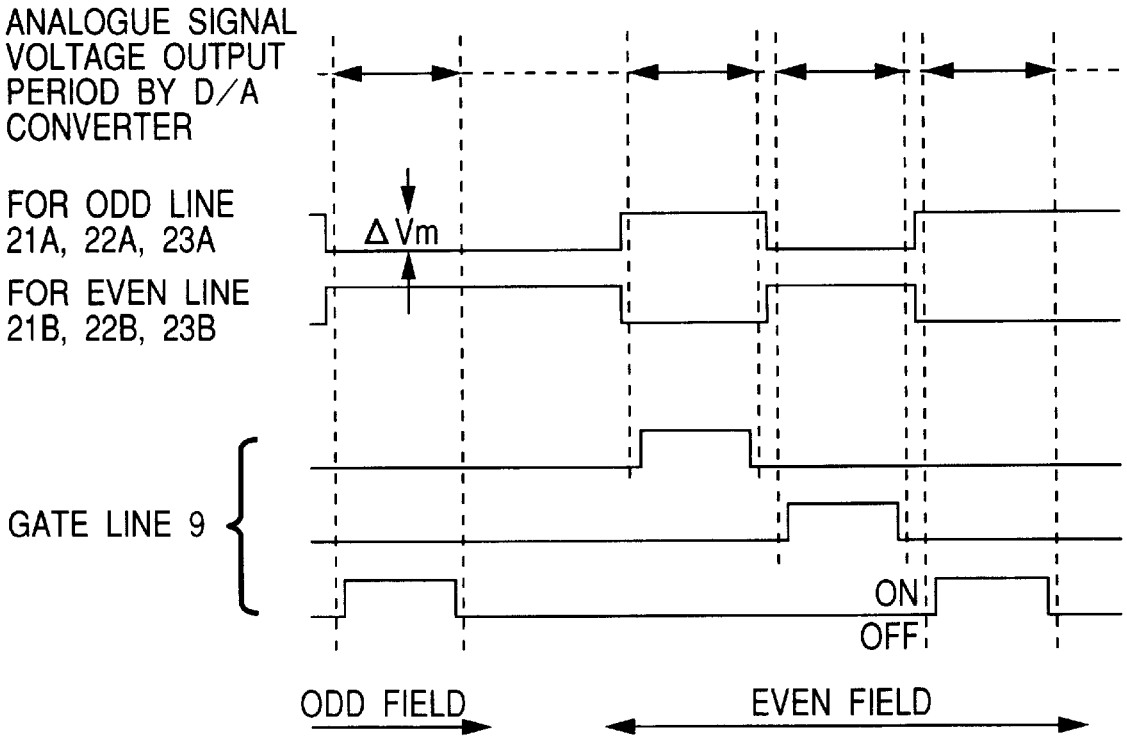
FIG. 4 is an analog buffer driving timing chart of the first embodiment.

The operation of the analog buffer 4 shown in FIG. 2 will be described in more detail hereinbelow with reference to the analog buffer driving timing chart shown in FIG. 4. For simplicity of explanation, the number of gate lines 9 is expressed as three. In the beginning of an even field, the high voltage power line 21A, low voltage power line 22A, and bias line 23A for driving the odd-numbered analog buffers 4 are set to a high voltage state. The high voltage power line 21B, low voltage power line 22B, and bias line 23B for driving the even-numbered analog buffers 4 are set to a low voltage state. The potential difference between the high voltage state and the low voltage state is ΔVm defined in FIG. 3. The drive voltages of the odd-numbered and even-numbered analog buffers 4 are the same voltage except that the voltages alternately enter the high and low voltage states. After completion of setting the voltages of the high voltage power lines 21A and 21B, low voltage power lines 22A and 22B, and bias lines 23A and 23B by the drive voltage shifting circuit 12, the DA converter 5 outputs an analog signal voltage, subsequently, a predetermined gate line 9 is selected by the gate line driver 10 to turn on a pixel switch in a predetermined row, and an operation of writing the analog signal voltage to the liquid crystal display capacitor via the analog buffer is started. By turning off the gate line 9 again, a display pixel write period of one horizontal period is completed. When the analog signal voltage output from the DA converter 5 is stopped, the high voltage power line 21A, low voltage power line 22A and bias line 23A for the odd-numbered analog buffer 4 are shifted to the low voltage state. The high voltage power line 21B, low voltage power line 22B, and bias line 23B for driving the even-numbered analog buffer 4 are shifted to the high voltage state. After that, by repeating the above operations, the analog signal voltage is written to the display pixels column by column. The shifting of the high voltage power lines 21A and 21B, low voltage power lines 22A and 22B, and bias lines 23A and 23B is not performed at the end of each field for the following reason. Since the number of gate lines 9 is an odd number in the embodiment, the driving voltage of the analog buffer 4 is alternately shifted between the low voltage state and the high voltage state field by field. It is therefore understood that, if the number of gate lines 9 is an even number, the high voltage power lines 21A and 21B, low voltage power lines 22A and 22B, and bias lines 23A and 23B have to be shifted once more at the end of each field or the shifting for the first time in each field has to be stopped. It is obvious from the above description that, an analog signal voltage input to the analog buffer 4 when the analog buffer 4 is driven in a low voltage state lies in a range from VB− to VW− of a voltage applied to the liquid crystal. When the analog buffer 4 is driven in the high voltage state, the analog signal voltage input to the analog buffer 4 lies in a range from VW+ to VB+ of the voltage applied to the liquid crystal.

Figure 5:
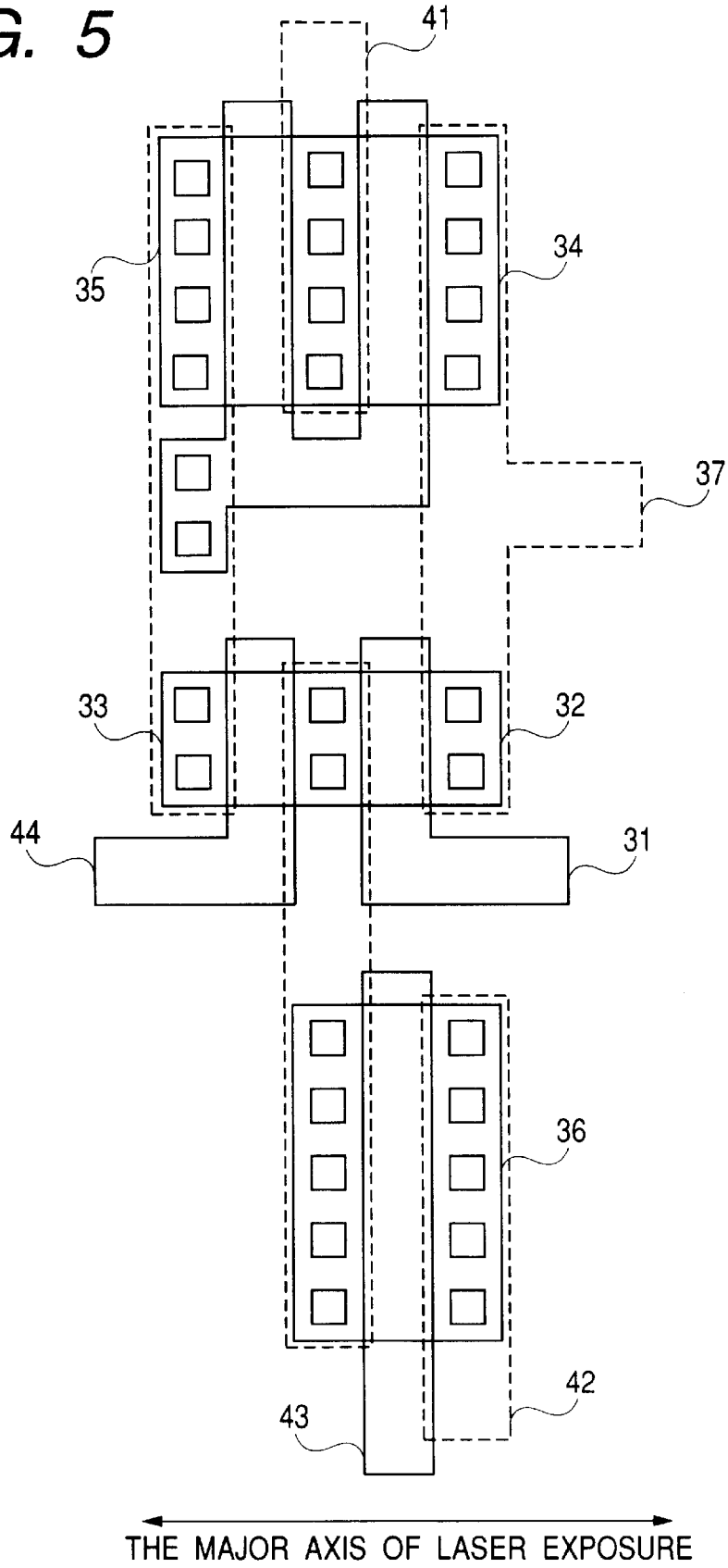
FIG. 5 is an actual layout of a differential amplifier of the first embodiment.

FIG. 5 is an actual layout of a differential amplifier in the analog buffer 4 shown in FIG. 2. The differential amplifier is constructed by the driver transistors 32 and 33 having the input terminal 31 and a feedback input terminal 44, load transistors 34 and 35, and current source transistor 36. The load transistors 34 and 35 take the form of p-type poly-Si TFT (Thin-Film-Transistor). The driver transistors 32 and 33 and the current source transistor 36 take the form of n-type poly-Si TFT. A high voltage power line 41 connected to the high voltage power lines 21A and 21B is connected to the sources of the load transistors 34 and 35. A low voltage power line 42 connected to the low voltage power lines 22A and 22B is connected to the source of the current source transistor 36. A bias line 43 connected to the bias lines 23A and 23B is connected to the gate of the current source transistor 36. The differential output line 37 extends from the differential amplifier to an amplifier at the post stage. A square indicates a contact hole 40 for interconnection, broken lines indicate an Al wiring layer, and solid lines indicate poly-Si islands and a metal gate wiring layer. In the embodiment, an analog buffer 51 is constructed by using a poly-Si TFT, so that in addition to an advantage such that it is unnecessary to isolate transistor substrates from each other and the nMOS and the pMOS can be designed in layout at almost the same interval, there is also an advantage such that it is unnecessary to drive a substrate voltage by using the drive voltage shifting circuit 12. Although the invention can be obviously applied even when the analog buffer 4 is constructed by an MOS transistor using a single crystal Si substrate, at the time of driving the substrate voltage, the pn junction has to be always set in a reverse-biased state. Consequently, the advantage of the poly-Si TFT circuit that it is unnecessary to drive the substrate voltage is a great advantage in terms of cost. Similarly, by using a completely depleted SOI (Silicon-On-Insulator) transistor circuit to which the substrate voltage does not have to be supplied from the outside, such an advantage can be enjoyed. Needless to say, the poly-Si TFT circuit has a greater advantage in terms of cost.

Attention has to be paid to the differential amplifier with respect to a point that variations in characteristics between pair transistors such as driver transistors 32 and 33 and the load transistors 34 and 35 cause the variations in the characteristics of the whole analog buffer 4. In the embodiment, since the poly-Si TFTs having relatively large variations in characteristics obtained by crystallizing an amorphous Si film by using a pulse laser irradiating process are used as the transistors, the problem is more serious for the following reason. A crystallization pulse laser emits a beam in a rectangular window shape having the major axis of 30 cm and the minor axis of 300 microns, an end area of the laser beam occurs in the minor axis direction, and the transistor characteristic in the area becomes different from that in normal time. In the embodiment, therefore, to solve the variations in characteristics between the pair transistors, as shown in FIG. 5, the major axis direction of the laser and the arrangement direction of the pair transistors are set to be the same. In this case, when one of the pair transistors is in the end area of the laser beam, the other is similarly in the end area of the laser beam, so that variations in the characteristics between the pair transistors can be eliminated. By setting the direction of a channel current of the transistors and the major axis direction of the laser to be parallel with each other, it can avoid that all the channel of a transistor whose transistor width is widened to expect higher current driving capability enters the end portion of a laser beam and the characteristics deteriorate. It is more important in the layout of the amplifier at the post stage.

Figure 6:
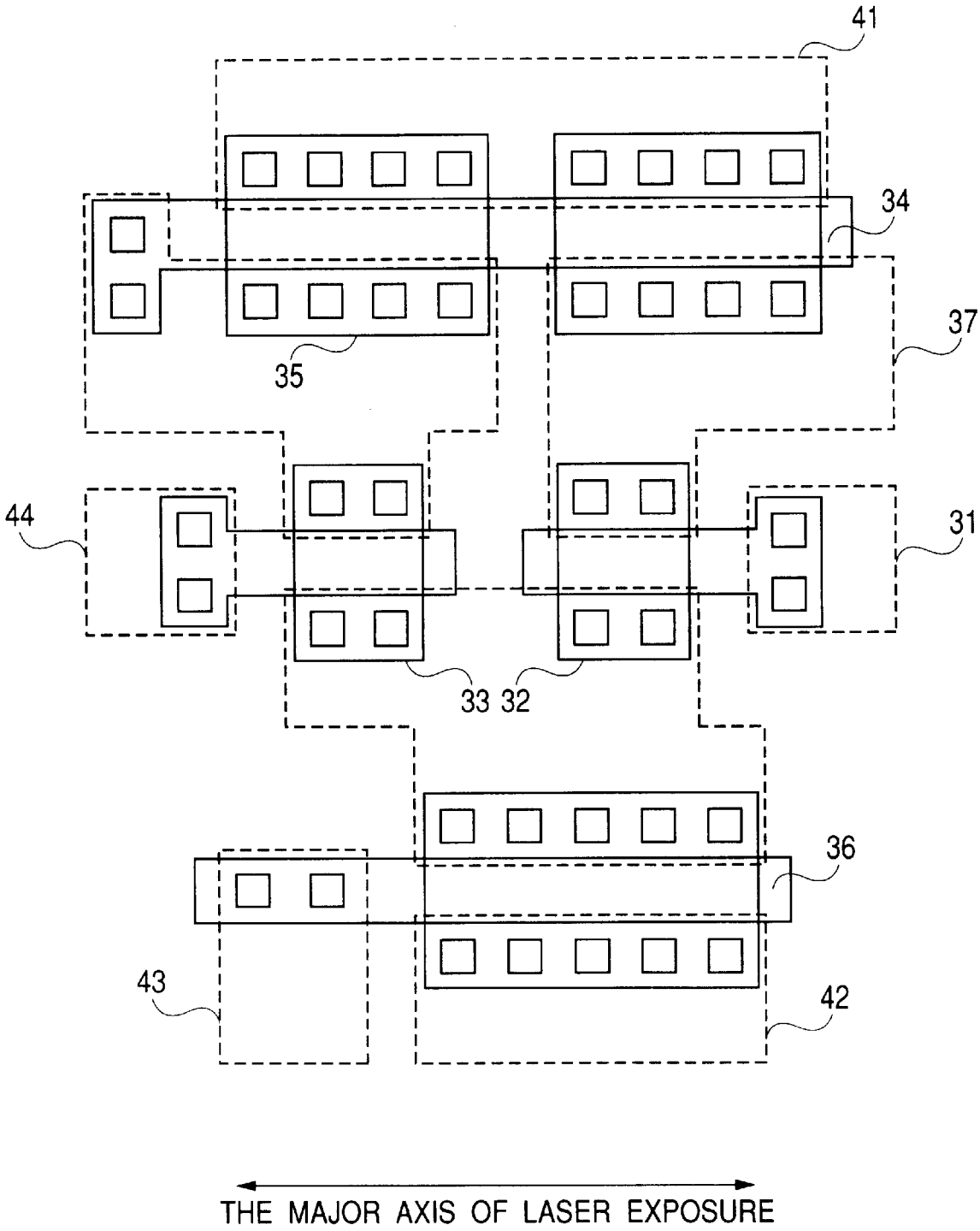
FIG. 6 is another actual layout of the differential amplifier of the first embodiment.

In the embodiment, not only the actual layout of the differential amplifier described in FIG. 5, but also the actual layout of another differential amplifier shown in FIG. 6 can be also employed. Since the numbers, operation, advantages, and the like shown in the layout are the same as those of the differential amplifier described in FIG. 5, their description will not be repeated here. Also in the actual layout of the another differential amplifier shown in FIG. 6, similarly, by setting the major axis direction of the laser and the arrangement direction of the pair transistors to the same, variations in the characteristics of the differential amplifier caused by the laser beam end areas are solved. The pulse laser irradiating process is not limited to the differential amplifier used for an image display device but is effectively used as a general semiconductor device processing technique.

Although the display pixels in FIG. 1 are shown by two rows and three columns in the embodiment, it is obvious that an effect of the embodiment does not depend on the number of display pixels. Obviously, as the circuit form of the analog buffer shown in FIG. 2, the circuit of a single crystal Si transistor and various circuit configurations including interchange of the pMOS and nMOSs can be employed. Regarding the layout of the differential amplifier shown in FIG. 5, various transistors including co-planar or inverse staggered configuration, or LDD (Lightly-Doped Drain) or single drain can be applied.

Second Embodiment

Figure 7:
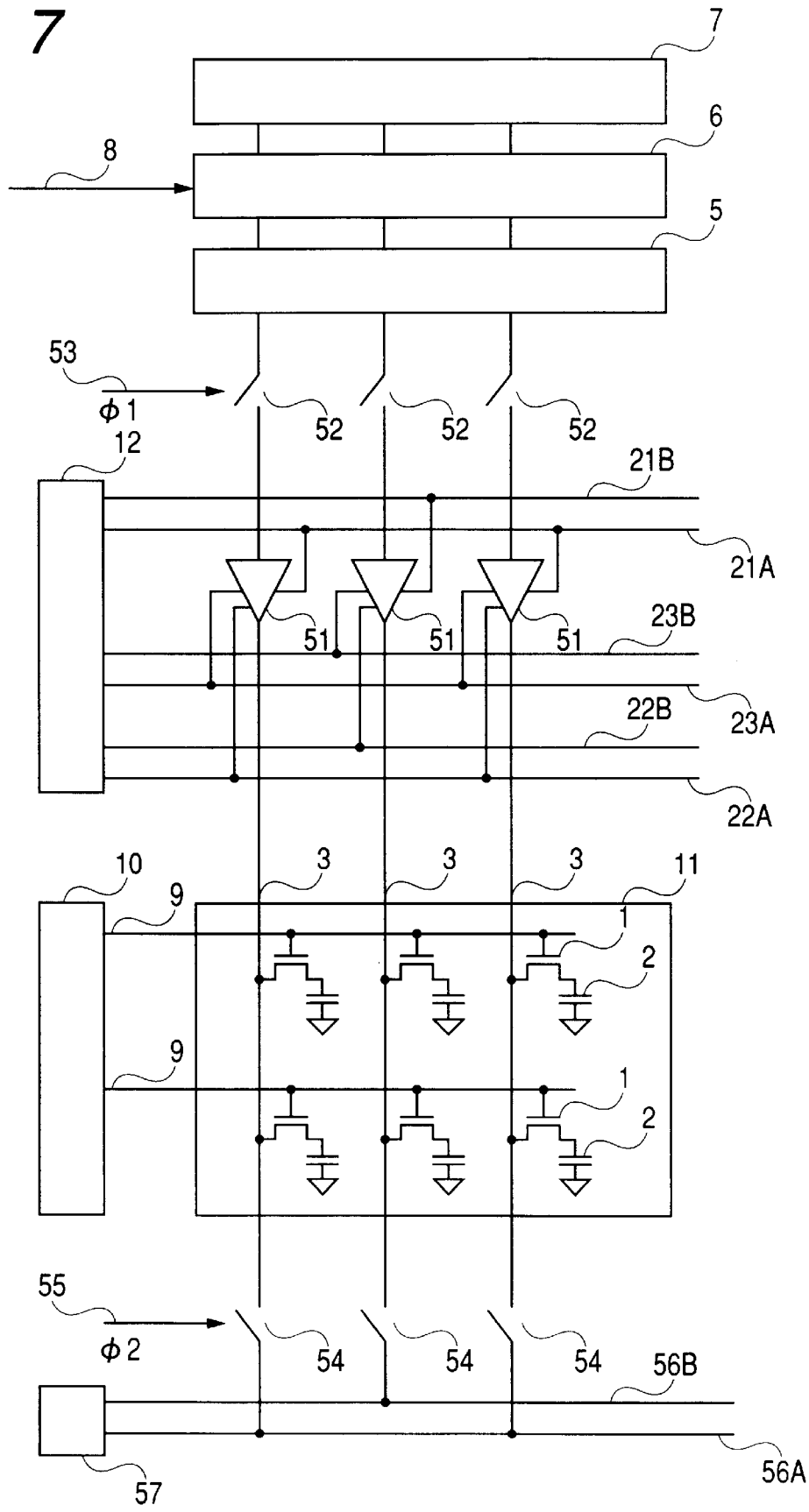
FIG. 7 is a configuration diagram of a second embodiment.

Another embodiment of the invention will be described hereinbelow with reference to FIGS. 7 to 9. FIG. 7 is a configuration diagram of another embodiment of an image display device according to the invention. Display elements each constructed by the pixel switch 1 and the liquid crystal display capacitor 2 connected in series to one end of the pixel switch 1 are arranged in a matrix within the display pixel area 11. The gate of the pixel switch 1 is connected to the gate line driver 10 via the gate line 9, and the other end of the pixel switch 1 is connected to the analog buffer 51 via the signal line 3. An output of the DA converter 5 is connected to the analog buffer 51 via an input signal change-over switch 52 controlled by an input signal timing line 53. An output of the data latch 6 is also connected to the DA converter 5. An output of the shift-register 7 and the digital input signal line 8 are connected to the data latch 6. Further, to the analog buffer 51, a set of high voltage power lines 21A and 21B, a set of low voltage power lines 22A and 22B, and a set of bias lines 23A and 23B are connected. The high voltage power lines 21A and 21B, low voltage power lines 22A and 22B, and bias lines 23A and 23B are connected to the drive voltage shifting circuit 12. On the other hand, the other end of the signal line 3 is connected to precharge power lines 56A and 56B via a precharge switch 54 controlled by a precharge timing line 55. Further, the precharge power lines 56A and 56B are connected to a precharge voltage shifting circuit 57.

The operation of the embodiment will be briefly described hereinbelow. A digital input signal supplied from the digital input signal line 8 is latched by the data latch 6 in association with scanning of the shift-register 7. The digital input signal latched by the data latch 6 is converted to an analog signal voltage by the DA converter 5 and the analog signal voltage is input to the signal line 3 via the analog buffer 51. Since the gate line driver 10 turns on the pixel switch 1 in a selected row via the gate line 9 at a predetermined timing, the analog signal voltage is written into the liquid crystal display capacitor 2 in the selected pixel row.

In the embodiment, prior to the application of the analog signal voltage to the signal line 3 by the analog buffer 51, an operation of precharging the signal line 3 is performed. The details including the configuration and operation of the analog buffer 51 will be described hereinbelow.

Figure 8:
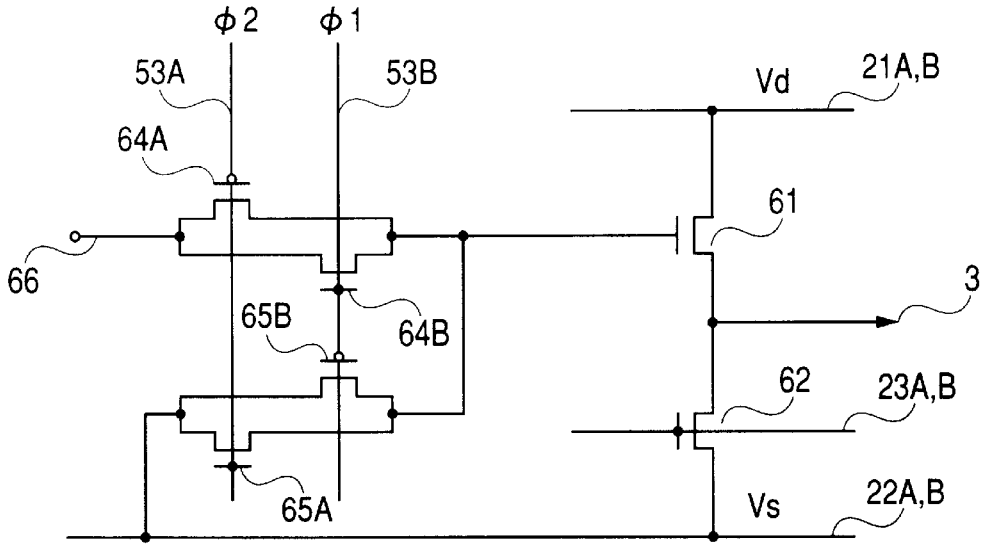
FIG. 8 is a circuit configuration diagram of an analog buffer of the second embodiment.
Figure 9:
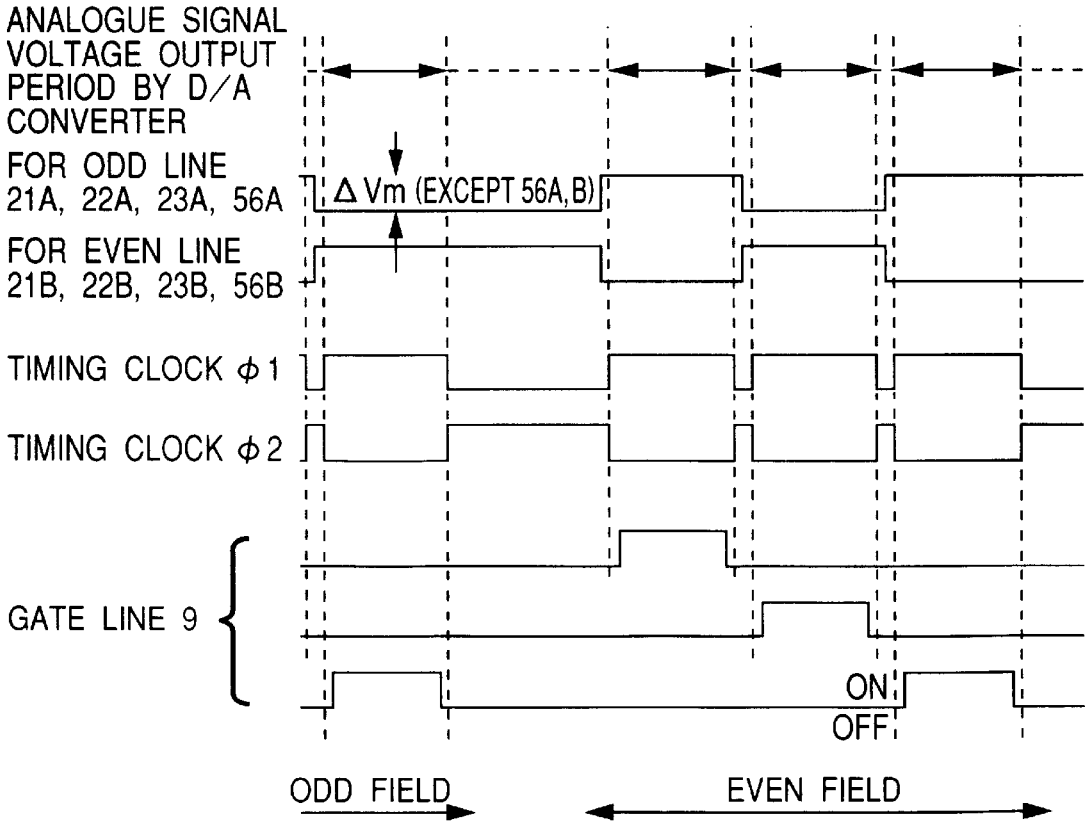
FIG. 9 is an analog buffer driving timing chart of the second embodiment.

FIG. 8 is a circuit configuration diagram of the analog buffer 51 including the input signal change-over switch 52. An analog signal voltage input from an input terminal 66 is supplied to a driver transistor 61 in a source follower circuit via a first CMOS analog switch constructed by a pMOS 64A and an nMOS 64B driven by input signal timing lines 53A and 53B, respectively. The source follower circuit is constructed by the driver transistor 61 and a load transistor 62, and an output of the source follower circuit is connected to the signal line 3. A high voltage source Vd side of the analog buffer 51 constructed by the source follower circuit is connected to the high voltage power lines 21A and 21B, and a low voltage source side is connected to the low voltage power lines 22A and 22B. The gate of the load transistor 62 is connected to the bias lines 23A and 23B. The odd-numbered and even-numbered analog buffers 51 are alternately connected as shown in FIG. 7 in such a manner that odd-numbered analog buffers 51 are connected to the high voltage power line 21A, low voltage power line 22A, and bias line 23A, and even-numbered analog buffers 51 are connected to the high voltage power line 21B, low voltage power line 22B, and bias line 23B. The low voltage power lines 22A and 22B are connected to the driver transistor 61 in the source follower circuit via a second CMOS analog switch constructed by an nMOS 65A and a pMOS 65B driven by the input signal timing lines 53A and 53B, respectively.

In the explanation of the first embodiment, the liquid crystal display characteristics of an image signal has been described. Since they are similar in the second embodiment as well, the description will not be repeated but the symbols such as ΔVm will be similarly used.

The operations of the analog buffer 51, signal input change-over switch 52, and precharge switch 54 shown in FIG. 8 will be described hereinbelow with reference to the analog buffer driving timing chart shown in FIG. 9. For simplicity of explanation, the number of gate lines 9 is expressed as three. In the beginning of the even-numbered field, the high voltage power line 21A, low voltage power line 22A, and bias line 23A for driving the odd-numbered analog buffers 51 are set to a high voltage state. The high voltage power line 21B, low voltage power line 22B, and bias line 23B for driving the even-numbered analog buffers 51 are set to a low voltage state. The potential difference between the high voltage state and the low voltage state is ΔVm described above. The drive voltages of the odd-numbered and even-numbered analog buffers 51 are the same voltage except that the voltages alternately enter the high and low voltage states. At this time, a timing clock ϕ1 is set to "low" and a timing clock ϕ2 is set to "high". The timing clocks ϕ1 and ϕ2 are clock pulses having reverse phases and applied to the input signal timing lines 53*b* and 53A, respectively, as shown in FIG. 8. The gate of the driver transistor 61 in the source follower circuit is connected to the low voltage power lines 22A and 22B, and the driver transistor 61 is in a turned-off state. The timing clocks ϕ1 and ϕ2 are also similarly applied to the precharge switch 54. Since the precharge switch 54 is driven in phases opposite to those of the input signal change-over switch 52, at this time, the precharge switch 54 is also turned on and the signal line 3 is connected to the precharge power lines 56A and 56B. Although the precharge power lines 56A and 56B are set to VW+ and VB−, respectively, the voltages of the precharge power lines 56A and 56B are shifted so as to be inverted to each other synchronously with the drive voltage shifting circuit 12 by the precharge voltage shifting circuit 57. After completion of precharging of the signal line 3 by the precharge switch 54, when the DA converter 5 starts outputting an analog signal voltage, simultaneously, the timing clocks ϕ1 and ϕ2 are set to "high" and "low", respectively, the input signal change-over switch 52 is turned on, and the precharge switch 54 is turned off. It makes the source follower circuit enter a conductive state. The source follower circuit buffers an input analog signal voltage and outputs it to the signal line 3. The odd signal lines 3 are precharged to VW+ via the precharge power line 56A. On the other hand, the analog signal voltage lies in the range from VW+ to VB+, so that the load on the driver transistor 61 of the source follower circuit decreases by the precharging operation and, simultaneously, a write charge to the signal line 3 remaining from the previous writing operation can be cleared. The even signal lines 3 are also precharged to VB− via the precharge power line 56B and, on the contrary, the analog signal voltage lies in the range from VB− to VW+. Therefore, it is obvious that the load on the driver transistor 61 is similarly therefore decreased by the precharge operation and the write charge to the signal line 3 remaining from the previous writing operation can be cleared. In this state, a predetermined gate line 9 is selected by the gate line driver 10 to turn on the pixel switch in the predetermined row, and the writing of the analog signal voltage to the liquid crystal display capacitance via the analog buffer is started. By turning off the gate line 9 again, the display pixel write period of one horizontal period is completed. Next, upon stop of the analog signal voltage output from the DA converter 5, the timing clocks ϕ1 and ϕ2 are set again to "low" and "high", respectively. Subsequently, the high voltage power line 21A, low voltage power line 22A, bias line 23A, and not-illustrated precharge power line 56A for driving the odd analog buffers 51 are shifted to the low voltage state. The high voltage power line 21B, low voltage power line 22B, bias line 23B, and precharge power line 56B for driving the even analog buffers 51 are shifted to the high voltage state. After that, by repeating the above operations, the analog signal voltage is written to the display pixels column by column. The shifting of the high voltage power lines 21A and 21B, low voltage power lines 22A and 22B, bias lines 23A and 23B, and precharge power lines 56A and 56B is not performed at the end of each field for the following reason. Since the number of gate lines 9 is an odd number in the embodiment, the driving voltage of the analog buffer 51 to be written in the same pixel every field is alternately shifted between the low voltage state and the high voltage state. It is therefore understood that, if the number of gate lines 9 is an even number, the high voltage power lines 21A and 21B, low voltage power lines 22A and 22B, bias lines 23A and 23B, and precharge power lines 56A and 56B have to be shifted once more at the end of each field or the shifting for the first time in each field has to be stopped. It is obvious from the above description that, an analog signal voltage input to the analog buffer 51 when the analog buffer 51 is driven in a low voltage state lies in a range from VB− to VW− of a voltage applied to the liquid crystal. When the analog buffer 51 is driven in the high voltage state, the analog signal voltage input to the analog buffer 51 lies in a range from VW+ to VB+ of the voltage applied to the liquid crystal.

The embodiment has particularly an advantage that the current consumption in the analog buffer 51 can be reduced. Since the writing to the signal line 3 is basically performed on the driver transistor 61 side, a through current passing through the load transistor 62 can be designed to be sufficiently low as long as the operation of the analog buffer 51 does not become unstable. Further, there are also advantages that the circuit configuration of the analog buffer 51 is simple and the layout area can be reduced. Although the operation voltages of the precharge power lines 56A and 56B are set to two values of VB− and VW+ in the embodiment, they can be set to the same value as the drive voltage of the low voltage power lines 22A and 22B from the viewpoint of simplification of the peripheral circuits.

Although an actual layout or the like is not shown, the analog buffer is constructed by using a poly-Si TFT also in the embodiment. Consequently, there are advantages such that it is unnecessary to isolate transistor substrates from each other and the nMOS and the pMOS can be designed in layout at almost the same interval and, in addition, it is unnecessary to drive an even substrate voltage by using the drive voltage shifting circuit 12. There is another advantage such that, by using a high resistance element made of poly-Si or the like in place of the load transistor 62, or an open end is provided as an extreme case, the bias lines 23A and 23B can be omitted.

Third Embodiment

Figure 10:
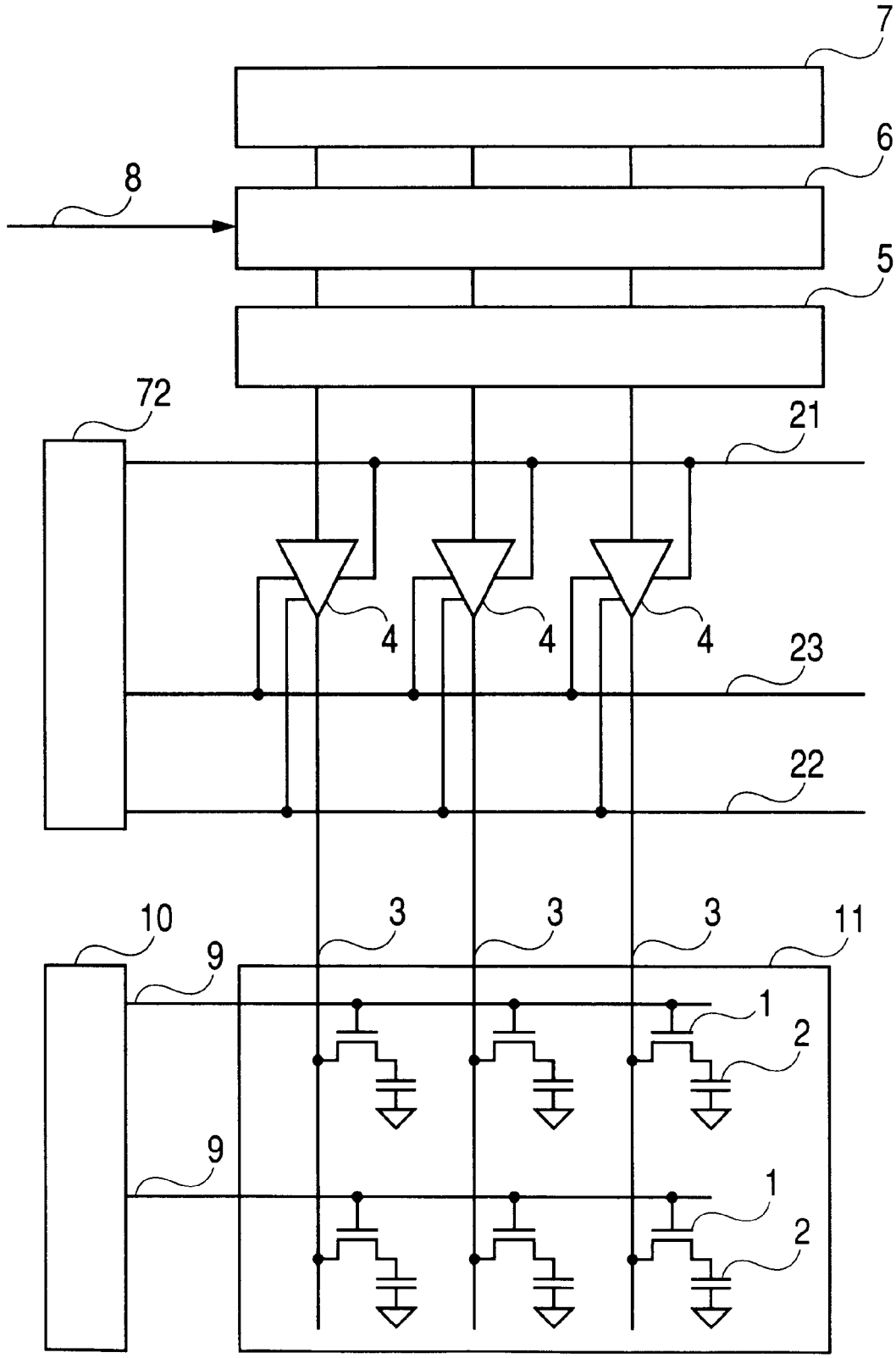
FIG. 10 is a configuration diagram of a third embodiment.

Another embodiment of the invention will be described hereinbelow with reference to FIG. 10. FIG. 10 is a configuration diagram of an embodiment of an image display device according to the invention. Display elements each constructed by the pixel switch 1 and the liquid crystal display capacitor 2 are arranged in a matrix within the display pixel area 11. The gate of the pixel switch 1 is connected to the gate line driver 10 via the gate line 9. One end of the pixel switch 1 is connected to the analog buffer 4 via the signal line 3. An output of the DA converter 5 is connected to the analog buffer 4, and an output of the data latch 6 is connected to the DA converter 5. An output of the shift-register 7 and the digital input signal line 8 are connected to the data latch 6. The high voltage power line 21, low voltage power line 22, and bias line 23 are connected to the analog buffer 4 and are also connected to a drive voltage shifting circuit 72. The drive voltage shifting circuit 72 is a circuit for supplying two values of low impedance output voltages to each output line as will be described hereinlater.

The operation of the embodiment will be described hereinbelow. A digital input signal supplied from the digital input signal line 8 is latched by the data latch 6 in association with scanning of the shift-register 7. The digital input signal latched by the data latch 6 is converted to an analog signal voltage by the DA converter 5 and the analog signal voltage is input to the signal line 3 via the analog buffer 4. Since the gate line driver 10 turns on the pixel switch 1 in a selected row via the gate line 9 at a predetermined timing, the analog signal voltage is written into the liquid crystal display capacitor 2 in the selected pixel row.

The analog buffer 4 in FIG. 10 is the same as that disclosed in the first embodiment, so that description of the configuration, operation, and the like of the analog buffer 4 will not be repeated here. However, the difference of the third embodiment from the first embodiment is that the same high voltage power line 21, low voltage power line 22, and bias line 23 are used for the odd-numbered and even-numbered analog buffers. Consequently, in the third embodiment, so-called dot (pixel) inverting driving or column-base inverting driving of a liquid crystal which can be performed in the first embodiment cannot be executed. It is therefore necessary to select row-base inverting driving or field-base inverting driving, so that the picture quality tends to be inferior. However, the third embodiment has an advantage that the wiring layout of the analog buffer 4 and the configuration of the drive voltage shifting circuit 72 can be simplified. The number of the analog buffers 4 of the embodiment can be selected from one per column of pixels, one per plurality of columns, or one in the whole device.

Fourth Embodiment

Figure 11:
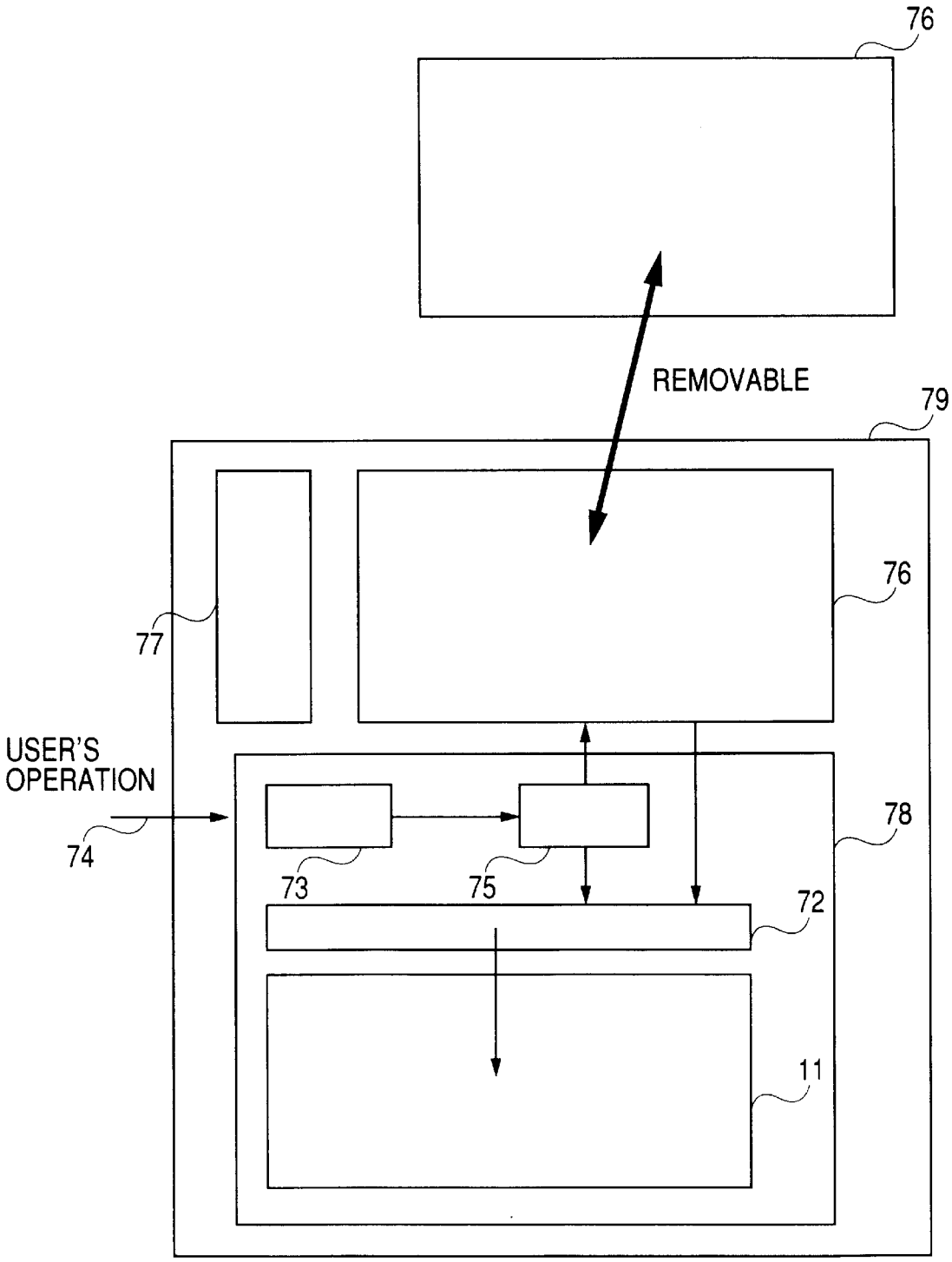
FIG. 11 is a configuration diagram of a fourth embodiment.
Figure 12:
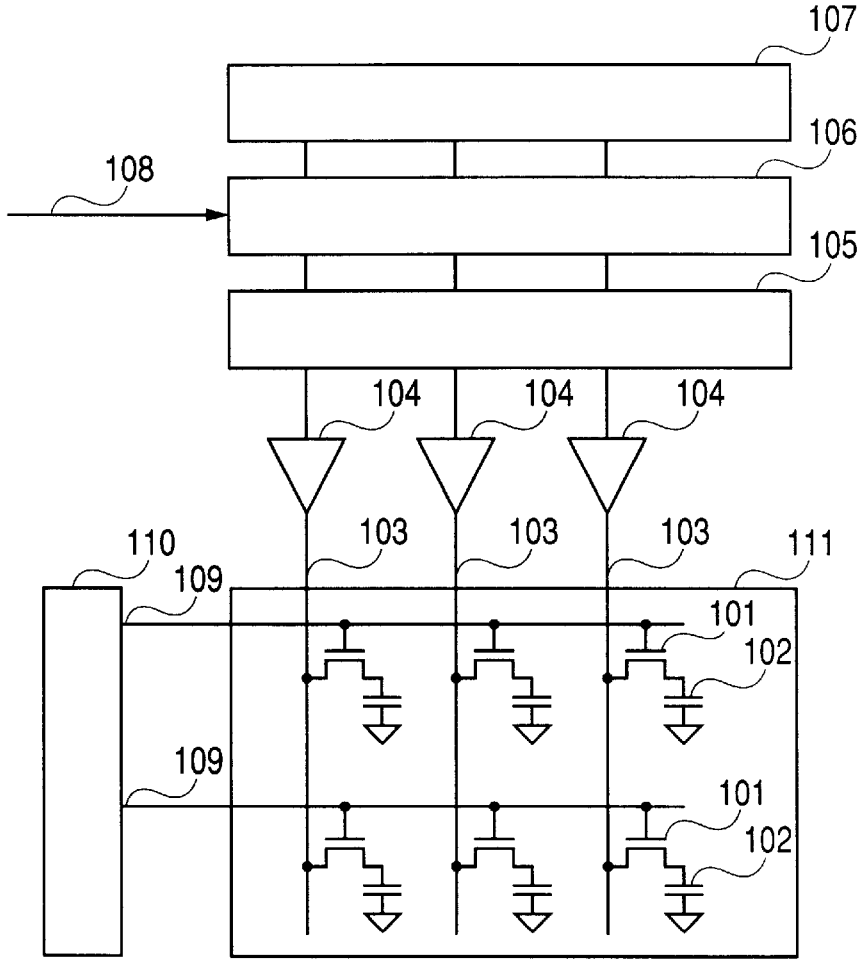
FIG. 12 is a configuration diagram of a conventional technique.
Figure 13:
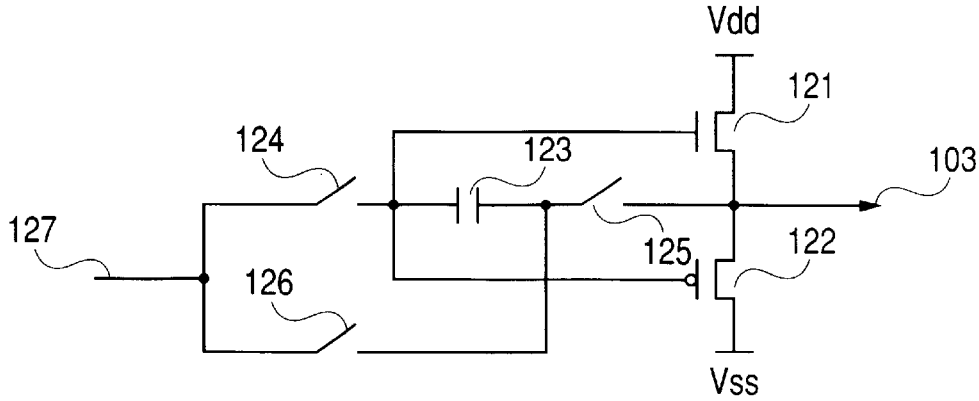
FIG. 13 is a circuit configuration diagram of a conventional analog buffer.

Another embodiment of the invention will be described hereinbelow with reference to FIG. 11. FIG. 11 is a configuration diagram of an embodiment of an image display device of the invention. The device is a hand-held display instrument 79 capable of displaying image information stored in a memory card 76. In the instrument, in addition to the removable memory card 76, a battery 77 and a glass substrate 78 are housed. On the glass substrate 78, an input/output interface circuit 73 for receiving button and touch panel operation 74 by the user and a microcomputer chip 75 are mounted. Further, the display pixel area 11 and the peripheral driving circuit 72 are integrally formed on the glass substrate 78 by using a poly-Si TFT circuit. The display image area 11 is the same one as disclosed in the first embodiment and, similarly, the peripheral driving circuit 72 is a group of peripheral circuits for driving the display image area 11, disclosed in FIG. 1 in the first embodiment.

A flash memory is housed in the memory card 76 and predetermined information such as electronic publishing information and the like is prestored via a PC or the like. The hand-held display instrument 79 can display output image data including text stored in the memory card 76 onto the display image area 11 in accordance with the operation of the user.

According to the embodiment, since the display image area 11 and the peripheral driving circuit 72 are already integrally formed on the glass substrate 78, the mounting cost can be reduced and further, a high-definition image without offset variations of the analog buffers can be displayed. The weight of the whole hand-held display instrument 79 can be further reduced by making the memory card substrate of plastic, using a polymer secondary battery as the battery 77, changing the glass substrate 78 to a plastic substrate, and using a reflective liquid crystal as the structure of the display pixel area 11.

What is claimed is:

1. An image display device comprising:

a display screen in which a plurality of display pixels in each of which a liquid crystal capacitor for displaying an image and a pixel switch for writing an image signal voltage into the liquid crystal capacitor are connected in series are arranged in a matrix, image signal voltage generating means for generating said image signal voltage which changes alternately between a positive voltage and a negative voltage every one of even-numbered and odd-numbered fields to said liquid crystal capacitor, and impedance converting means for reducing an output impedance of the image signal voltage generating means and transmitting the image signal voltage to said pixel switch, characterized in that the image display device comprises drive voltage shifting means for shifting a voltage of driving said impedance converting means between a positive voltage area and a negative voltage area every one of said even-numbered and odd-numbered fields in accordance with the polarity of said image signal voltage.

2. The image display device according to claim 1, characterized in that said impedance converting means is provided every said pixel column, and the polarities of said voltage areas of the voltages of driving the impedance converting means in said pixel columns which are neighboring are opposite to each other.

3. The image display device according to claim 1, characterized in that said impedance converting means is provided every column of said pixels, and the polarity of all of said voltage areas of the voltage of driving said impedance converting means is the same.

4. The image display device according to claim 1, characterized in that one said impedance converting means is provided every column of said pixels, every plurality of columns, or in a whole device, and said voltage area of the voltage of driving said impedance converting means changes between a positive voltage area and a negative voltage area every row of said pixels.

5. The image display device according to claim 1, characterized in that a shift amount of said drive voltage of said drive voltage shifting means is a voltage difference between a positive voltage and a negative voltage of an image signal voltage value at which a slope of a characteristic curve of voltage of a liquid crystal in said liquid crystal capacitor-display brightness is the sharpest.

6. The image display device according to claim 1, characterized in that said impedance converting means includes a differential amplifier of which voltage gain is set to substantially 1 by negative feedback.

7. The image display device according to claim 1, characterized in that said impedance converting means is constructed by a source follower circuit.

8. The image display device according to claim 1, characterized in that a substrate potential of a transistor element as a component of said impedance converting means is not supplied from the outside of the transistor.

9. The image display device according to claim 1, characterized in that the transistor device as a component of said impedance converting means is a thin film transistor or a completely depleted SOI (Silicon-on-Insulator) transistor.

10. The image display device according to claim 9, characterized in that a channel of said thin film transistor is formed in a polysilicon thin film.

11. The image display device according to claim 10, characterized in that said pixel switch is constructed by a thin film transistor of which channel is formed in a polysilicon thin film.

12. The image display device according to claim 1, characterized by comprising a precharge circuit including a voltage source and a switch, connected in parallel with said impedance converting means.

13. The image display device according to claim 12, characterized in that said voltage source of said precharge circuit has precharge voltage shifting means for shifting a drive voltage of said precharge circuit between a positive voltage area and a negative voltage area between said even-number and odd-number fields.

14. The image display device according to claim 13, characterized in that said drive voltage shifting means also serves as said precharge voltage shifting means.

15. The image display device according to claim 6, characterized in that said differential amplifier is constructed by a pair of thin film transistors having, as a substrate of a channel, a polysilicon thin film formed by scanning a rectangular pulse laser having a major axis and a minor axis in the minor axis direction, and an arrangement direction of the pair of thin film transistors is substantially in parallel with the major axis direction of said rectangular pulse laser.

16. The image display device according to claim 15, characterized in that the direction of a current passing through said pair of thin film transistors is substantially perpendicular to the major axis direction of said rectangular pulse laser.

17. The image display device according to claim 15, characterized in that the direction of a current passing through said pair of thin film transistors is substantially parallel with the major axis direction of said rectangular pulse laser.

18. The image display device according to claim 1, characterized by further comprising image output control means and display image data storing means.

19. The image display device according to claim 18, characterized in that said image output control means and said display screen are provided on the same insulating substrate and said display image data storing means is removable.

* * * * *